United States Patent [19]

Tran

[11] 4,144,091

[45] Mar. 13, 1979

[54] WINDOW WIPE

[76] Inventor: Nguon T. Tran, 786 9th Ave., San Francisco, Calif. 94118

[21] Appl. No.: 856,501

[22] Filed: Dec. 1, 1977

[51] Int. Cl.[2] ..... B08B 7/00; A47L 1/08

[52] U.S. Cl. ..... 134/6; 15/220A; 15/250.11

[58] Field of Search ..... 15/220 A, 103, 250.11, 15/220 R, 250.28, 250.29, 250.31; 134/6

[56] References Cited

U.S. PATENT DOCUMENTS

| | | | |
|---|---|---|---|
| 2,206,006 | 6/1940 | Hendrey | 15/220 A |
| 2,995,256 | 8/1961 | Schoenfisch | 206/373 X |
| 3,751,750 | 8/1973 | Kaftan | 15/220 A |

FOREIGN PATENT DOCUMENTS

| | | | |
|---|---|---|---|
| 1550330 | 11/1968 | France | 15/220 A |

*Primary Examiner*—Peter Feldman
*Attorney, Agent, or Firm*—Robert Charles Hill

[57] ABSTRACT

A window wipe suitable for wiping the outer surface of a windowpane is provided with a magnet on the inner surface of the pane, a magnetized cleaning element on the outer surface of the pane and a container on the outer surface for storing the cleaing element when not in use.

6 Claims, 4 Drawing Figures

FIGURE 4.
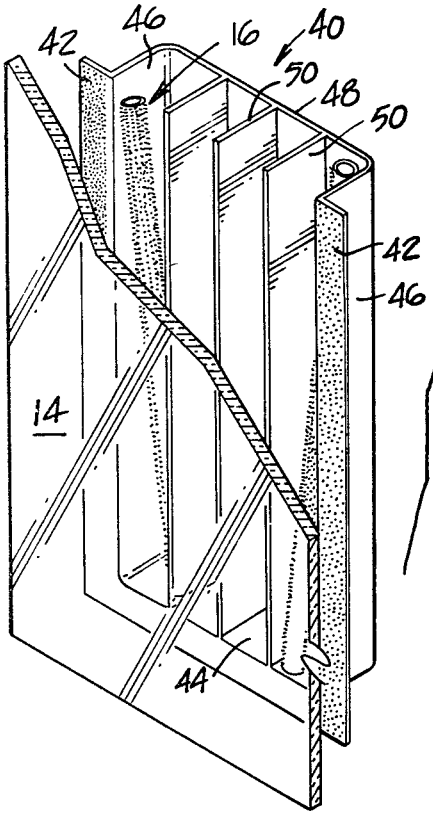
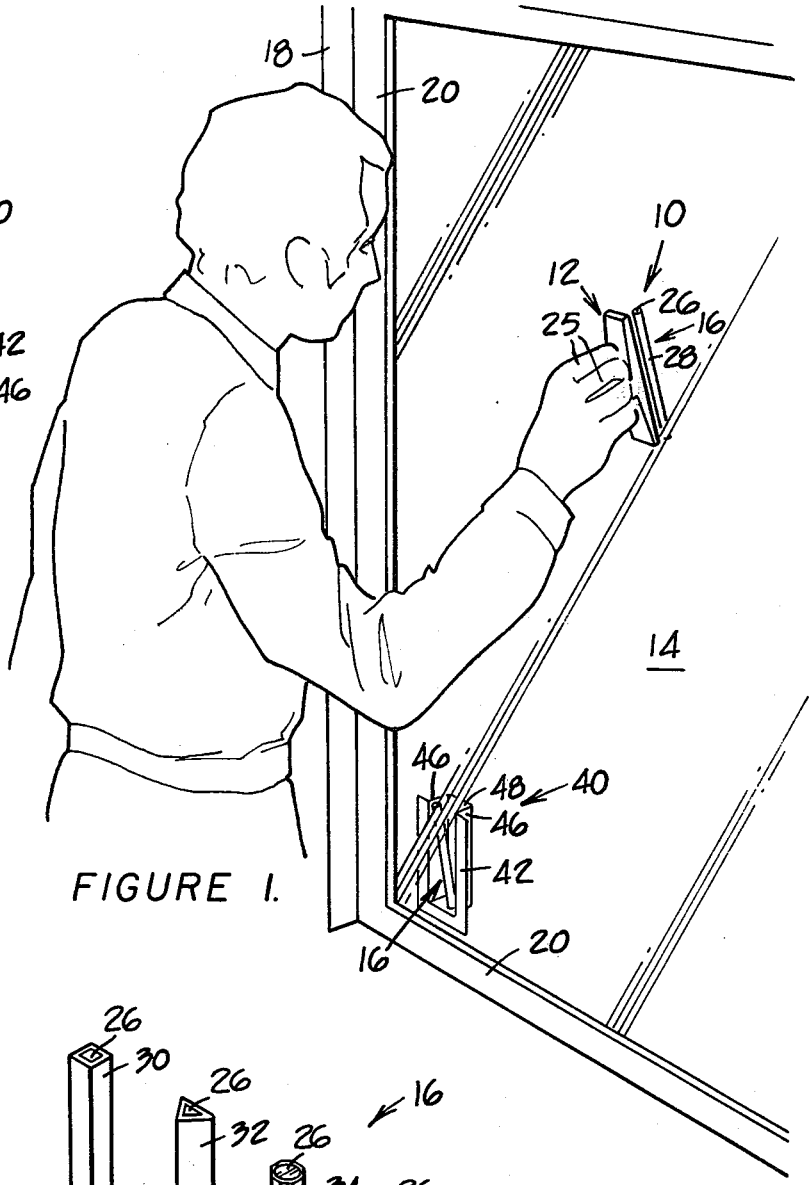
FIGURE 1.
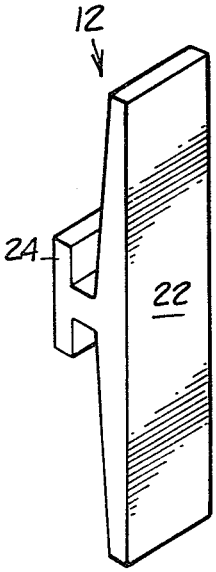
FIGURE 2.
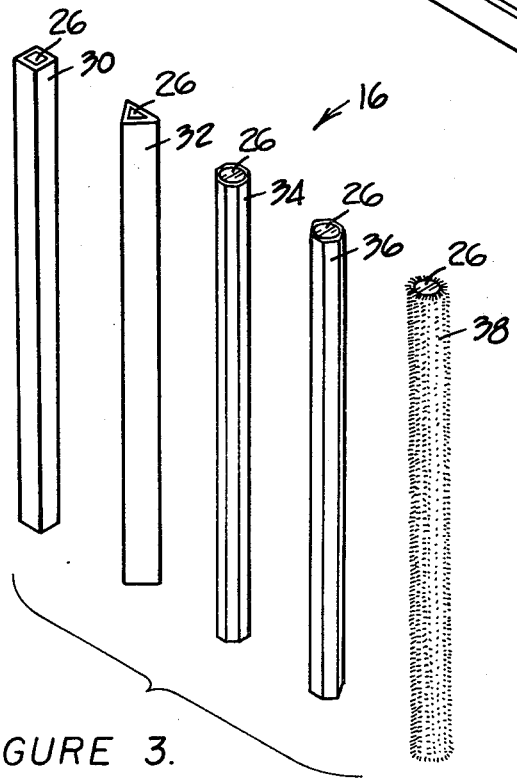
FIGURE 3.

WINDOW WIPE

SUMMARY OF THE INVENTION

The present invention relates to a structure for and method of wiping the outer surface of a windowpane. The window wipe has a magnet adapted to be moved over the inner surface of a windowpane, a container affixed to the outer surface of the pane and a cleaning element in the container caused to move over the outer pane surface by movement of the magnet.

BACKGROUND OF THE INVENTION

Cleaning the inner surfaces of windowpanes can be accomplished by a number of ways well-known to everybody. However, a clean inner surface of a windowpane is not very helpful to the overall general appearance of the window if the outer surface is dirty, spotted and smeared.

The inaccessibility of the outer surfaces of windowpanes presents a problem of long standing duration, since cleaning the outer surfaces can be hard, inconvenient and sometimes dangerous. This is especially true of windowpanes in houses and apartment buildings which cannot easily be reached from the ground or by means of a ladder or an extendable window washing device. As a result the outer surfaces of windowpanes in many dwellings are often cleaned less frequently than would otherwise be desirable. Sometimes, the only cleaning is by means of natural precipitation such as rain or snow.

Curiously enough, there is no known commercially available window wipe which provides a container on the outer surface of the windowpane for storing the magnetized cleaning element when not in use. The prior art related window cleaners all include large follower units which must be removed from the outer surface of the pane before the magnetic force is removed from the inner surface of the pane. The following United States patents include the closest prior art of which the inventor is aware:

U.S. Pat. Nos. 1,357,869; 1,603,175; 2,700,171; 2,805,438;

The present invention is convenient, economical and safe. It also greatly reduces the weight and surface of the cleaning element in touch with the windowpane.

OBJECTS OF THE INVENTION

It is the primary object of the present invention to provide a new and improved window wipe suitable for wiping the outer surface of a windowpane.

Another object is to provide a window wipe which can function without moving the window sash.

A further object is to provide structure which is inexpensive to manufacture and long lasting in usage.

BRIEF DESCRIPTION OF THE DRAWINGS

FIG. 1 is a perspective view of a windowpane provided with the window wipe of the present invention.

FIG. 2 is a perspective view of the inner surface member.

FIG. 3 is a perspective view illustrating the various shapes of the cleaning elements.

FIG. 4 is a perspective view of a container having a plurality of compartments.

DESCRIPTION OF THE PREFERRED EMBODIMENT

Referring to FIGS. 1 through 4 which illustrate the window wipe of the present invention, the window wipe generally indicated 10 has a magnet member generally indicated 12 adapted to be moved over the inner surface of a window 14 and a cleaning element generally indicated 16 caused to move over the outside surface of the windowpane 14 by movement of the magnet member 12. As can be seen in FIG. 1, a window frame 18 has a conventional type of sliding sash 20 which houses the windowpane 14 which is to be cleaned.

The magnet member 12 has a magnet portion 22 and a handle portion which can be gripped by the fingers 25 of the operator. While a rectangular magnet member 12 is shown in FIG. 2, it should be understood that the magnet member 12 can be of any desired shape. The size and shape of the magnet member 12 is often determined by the size and shape of the windowpane 14 and the nature of the cleaning element or elements 16 required thereon. If desired, a thin cloth buffer member may be attached to the magnet portion 22 to prevent any accidental scratching, etc., of the windowpane 14. Because the cleaning element 16 has a very lightweight, it is not necessary that the magnet portion 22 be as strong as the magnets shown in the prior art.

The cleaning element 16 has a body portion 26 of magnetic material such as steel or iron, etc., surrounded by a cleaning material 28 such as cotton, cloth, sponge or rubber. As seen in FIG. 3, the cleaning material may be in various shapes such as square 30, triangular 32, octagonal 34, hexagonal 36 and circular 38.

A container generally indicated 40 affixed to the outside of the windowpane 14 by a suitable adhesive stores the cleaning elements 16 when not in use. The container 40 has attaching portions 42 onto which the adhesive is placed, a bottom 44, sides 46, outer member 48 and an open top. As shown in FIG. 4, intermediate members 50 may be provided for dividing the container 40 into a plurality of compartments for storing a plurality of cleaning elements 16.

In actual operation and when it is desired to wipe the outer surface of windowpane 14, the magnet member 12 is positioned on the inner surface of windowpane 14 opposite container 40. Since the cleaning element 16 follows every movement of the magnet member 12, merely moving the magnet member 12 upward on the inner surface of the windowpane 14 removes the cleaning element 16 from container 40. The magnet member 12 draws the cleaning element 16 along and pulls it into intimate relation with the outer surface of windowpane 14 by the magnetic force so that the outside of the windowpane 14 is wiped as the magnet member is moved across the inner surface of windowpane 14. In this manner the entire outer surface area of windowpane 14 may be wiped. Once the container 40 is affixed to the outer surface of windowpane 14 and the cleaning elements 16 placed therein, the sliding window sash 20 does not have to be moved to wipe the outer surface of windowpane 14.

The types and shapes of the cleaning elements 16 depends upon the amount of moisture and dust, etc., on the outer surface of windowpane 14.

It will be obvious that numerous modifications and variations are possible for the above described window wipe within the scope of the present invention. The foregoing description, as setting forth various constructional and operational details for purposes of understanding only, is not to be taken as limiting the scope of the present invention which is defined only by the following claims.

I claim:

1. The method of wiping the outside of a window, comprising:

affixing a container to the outside of said window, placing a cleaning element in said container, using a magnet on the inside of said window to move said cleaning element out of said container and across the outside surface of said window and back into said container, and removing the magnet from the inside of the window after the cleaning element is back into the container.

2. A window wipe, comprising:

a magnet adapted to be moved over the inner surface of a window, a container having a plurality of compartments affixed to the outside of said window, and at least one cleaning element in said container whereby one cleaning element is caused to move over the outside surface of said window by movement of said magnet.

3. The window wipe of claim 2 wherein the cleaning element has a body portion of iron surrounded by a cleaning material.

4. The window wipe of claim 2 wherein the cleaning element is lightweight.

5. The window wipe of claim 2 wherein a plurality of cleaning elements are in the container.

6. The window wipe of claim 4 wherein the cleaning elements are in various shapes.

* * * * *